US005365498A

United States Patent [19]

Lazanyi

[11] Patent Number: 5,365,498

[45] Date of Patent: Nov. 15, 1994

[54] SUNDIAL-LIKE TIMEPIECE

[76] Inventor: Stephen Lazanyi, 221 Shakespeare Dr., Waterloo, Ontario, Canada, N2L 2T5

[21] Appl. No.: 115,607

[22] Filed: Sep. 3, 1993

[51] Int. Cl.[5] ..... G04B 19/06

[52] U.S. Cl. ..... 368/239; 368/240

[58] Field of Search ..... 368/223–243

[56] References Cited

U.S. PATENT DOCUMENTS

| | | | |
|---|---|---|---|
| 666,381 | 1/1901 | Gareau | 368/232 |
| 2,351,238 | 6/1944 | Teuber | 368/232 |
| 2,486,425 | 11/1949 | Loewe et al. | 368/232 |
| 3,156,990 | 11/1964 | Dock | 368/223 |
| 3,832,842 | 9/1974 | Parker | 368/223 |
| 4,034,549 | 7/1977 | Danley et al. | 368/79 |
| 4,036,009 | 7/1977 | Sampson | 368/233 |
| 4,374,623 | 2/1983 | Simon | 368/223 |
| 4,858,209 | 8/1989 | Chaut | 368/223 |

*Primary Examiner*—Bernard Roskoski
*Attorney, Agent, or Firm*—Arne I. Fors; Jeffrey T. Imai

[57] ABSTRACT

A sundial-like timepiece comprising a conventional clock mechanism including a surface having a plurality of time interval markings inscribed thereon. A light source is attached to the clock mechanism and is disposed a spaced distance from the surface. The light source is moved relative to the surface by the clock mechanism on either a twelve or twenty-four hour cycle. A gnomon is disposed in such a position relative to the surface that the light source causes a shadow of the gnomon to be cast onto the surface. As the light source moves relative to the surface, the shadow moves across the time interval markings, and time can be read off the timepiece by observing the position of the shadow relative to these markings. If the light source is not functional, the time cannot be read off the timepiece.

8 Claims, 2 Drawing Sheets

SUNDIAL-LIKE TIMEPIECE

BACKGROUND OF THE INVENTION

This invention relates to a timepiece, and, more particularly, relates to a sundial-like timepiece.

SUMMARY OF THE PRIOR ART

Sundials are the earliest known timepiece used by man. Basically, a sundial consists of a surface with a plurality of time intervals marked upon it. A gnomon or shadow casting member is disposed so that the rays of the sun cast a shadow of the gnomon upon the surface. The gnomon is positioned so that the shadow moves from one time interval marking to the next as the sun moves across the sky. Time is read off the sundial by noting the position of the shadow relative to the time interval markings.

Artificial sundials or sundial-like timepieces have been described in the prior art. Parker, for example, discloses an artificial sundial in U.S. Pat. No. 3,832,842, granted Sep. 3, 1974. In this device, a conventional clock motor 32 is connected by a shaft 34/62 to a shadow effect member 22 and a time indicator 74. The shaft 34/62 causes the member 22 and indicator 74 to rotate. The member 22 is disposed above a face 16 which has a plurality of time interval markings inscribed thereon, while the indicator 74 is disposed below the face 16. The member 22 is offset in relation to the indicator 74 so that a shadow of the member 22 appears to be cast upon the face 16. In reality, the "shadow" of the member 22 is the indicator 74. No shadow is cast upon the face 16, and the shadow effect member 22 is merely an aesthetic feature of the clock which creates the illusion that the clock is a sundial. The lamps 56 serve to eliminate the features of the clock mechanism which lie below the face 16 and to highlight the time indicator 74 on the face 16. Even if the lamps 56 are not functioning, a user can read the time off the clock by merely noting the position of the indicator 74.

SUMMARY OF THE INVENTION

The device of the present invention, on the other hand, functions in basically the same manner as the traditional sundial.

Traditional sundials are limited to use in sunny, daytime, outdoor conditions and have to be positioned correctly in order to indicate the correct time. Furthermore, the user's latitudinal location determines the position of the time interval markings on the dial face, and consequently a traditional sundial can only be used at the latitude for which it was designed.

The present invention tends to overcome the limitations of traditional sundials.

In its broad aspect, the timepiece of the present invention comprises a conventional clock mechanism including a motor and a surface having a plurality of time interval markings inscribed thereon. An illumination means is disposed a spaced distance from the surface and is adapted to illuminate the surface. The illumination means is connected to and driven by the motor so that it is movable relative to the surface. A gnomon means is disposed in such a position relative to the surface that the illumination means causes a shadow of the gnomon means to be cast upon the surface. As the illumination means moves relative to the surface, the shadow of the gnomon means moves in succession across the time interval markings, and time can be read off the timepiece by observing the position of the shadow relative to these markings. If the illumination means is not functional, the time cannot be read off the timepiece.

The motor may be adapted to move the illumination means relative to the surface on a twelve hour or twenty four cycle. The surface of the timepiece is therefore marked with either twelve or twenty four time interval markings.

In the preferred embodiment of the invention, the surface is substantially circular in shape and the gnomon means is disposed substantially at the centre of the surface and substantially at ninety degrees thereto. The illumination means is adapted to revolve around the longitudinal axis of the gnomon means. A drive shaft from the motor passes through a longitudinal bore in the gnomon means and an arm connected to the illumination means is fixedly connected to said drive shaft. The illumination means is disposed on one end of the arm and a counter-balance is disposed proximate the opposite end of the arm. In the preferred embodiment of the invention, the gnomon means may be stationary and the illumination means may move relative to the surface and to the gnomon means. Alternatively, the gnomon means may rotate in unison with the illuminating means.

In another embodiment of the invention, a spring means may be attached to the illumination means and be adapted to bias the illumination means to a first position relative to the time interval markings. When the illumination means moves from the first position to a remote second position so that the shadow of the gnomon means has moved in succession across each of the time interval markings, the spring means causes the illumination means to return to the first position.

BRIEF DESCRIPTION OF THE DRAWINGS

The preferred embodiment of the invention will now be described with reference to the following drawings, in which.

DETAILED DESCRIPTION OF THE PREFERRED EMBODIMENT

Figure 1:
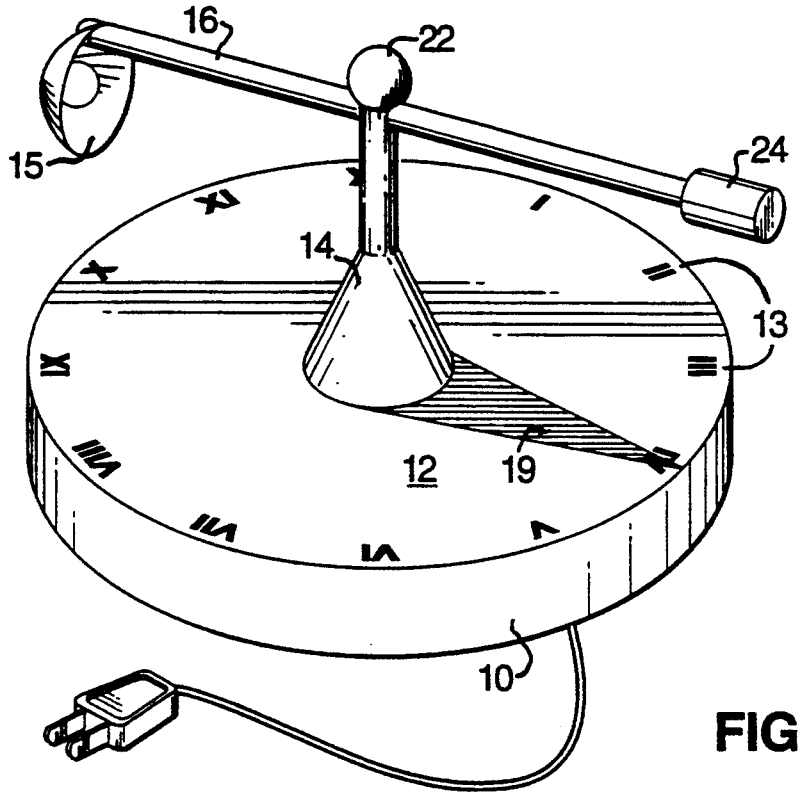
FIG. 1 is a perspective view of a first embodiment of a timepiece in accordance with the present invention.
Figure 2:
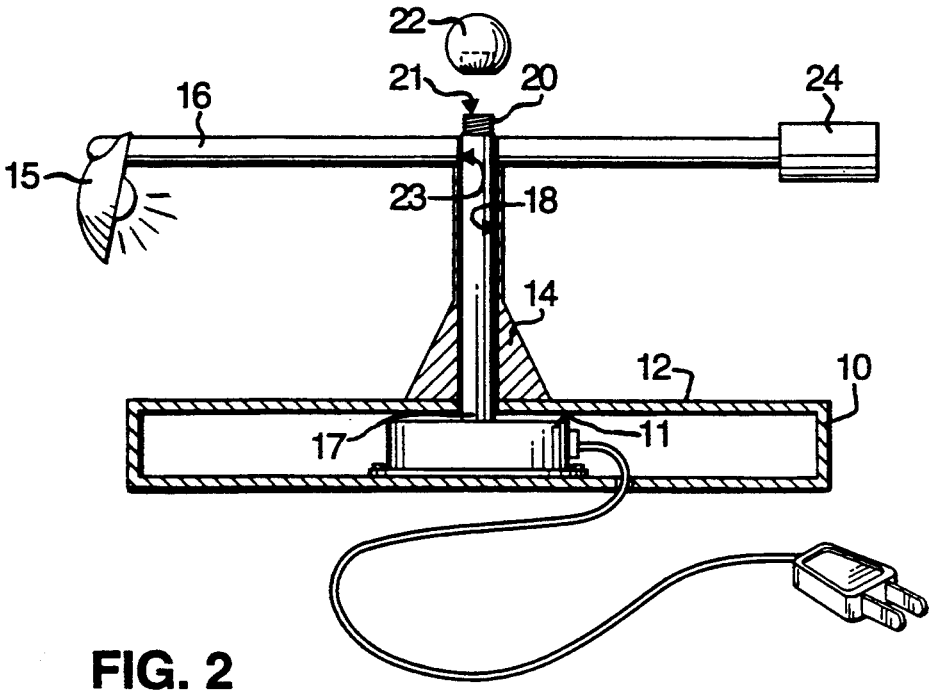
FIG. 2 is a partially exploded cross-section through the timepiece mechanism shown in FIG. 1.

Referring to FIGS. 1 & 2, there is shown a dock or timepiece in accordance with the present invention. The timepiece comprises a casing 10 which has a conventional clock motor 11 suitably mounted therein. The uppermost surface 12 of the casing 10 has a plurality of time interval markings 13 inscribed thereon. A gnomon 14 is mounted substantially in the centre of the face 12 and a light source 15 is connected via an arm 16 to a drive shaft 17 disposed in the bore 18 of the gnomon 14. In the preferred embodiment of the invention, the gnomon 14 is mounted substantially at 90° to the surface 12. The light source 15 is disposed a spaced distance from the surface 12 and is adapted to illuminate the same. When this occurs, the rays from the light source 15 cause a shadow 19 of the gnomon 14 to be cast upon the surface 12. The light source 15 is adapted to move relative to the surface 12 and as this occurs the shadow 19 moves across the surface 12 and touches the various time interval markings 13 in succession. The position of the shadow 19 indicates the time at any particular moment. Preferably, the gnomon 14 is symmetrically shaped so that the shadow 19 is uniform, no matter where the light source 15 is positioned.

The motor 11 is connected to an AC power source (not shown) but may of course be battery driven. The motor 11 drives the drive shaft 17 which is rotatably receivable within the bore 18 of the gnomon 14. The arm 16 is connected to the drive shaft 17 in such a manner that the motion of the drive shaft is transferred to the arm.

As shown in FIG. 2, the arm 16 may be connected to the drive shaft 17 by having mating threads 20 disposed proximate the distal end 21 of the drive shaft 17 and in the interior of a cap 22. The arm 16 is provided with a hole or slot 23 through which the drive shaft 17 is receivable, and the cap 22 is then screwed into position to secure the arm 16 to the drive shaft. The threads 20 must obviously be disposed in such a manner that detachment of the arm 16 is prevented during normal rotation of the light source 15. Alternatively, the cap 22 may be secured to the end 21 of the drive shaft by friction.

In an alternative embodiment of the invention (not shown), the gnomon 14 may be connected to the drive shaft 17 in such a manner that both the gnomon 14 and the arm 16 are rotated by the drive shaft 17. Once again, it is preferable if the gnomon 14 is of symmetrical shape to allow for accurate reading of time off the timepiece.

The light source 15 is mounted proximate a first end of the arm 16 and a counterweight 24 is mounted on the opposite end thereof. As the arm 16 is rotated by the drive shaft 17, the light source 15 is revolved around the longitudinal axis of the gnomon 14 causing the shadow 19 to move across the surface 12. The shadow 19 moves in succession from one time interval marking 13 to the next. If the light source 15 is switched off, no shadow 19 will be cast on the surface 12 and it will not be possible to read the time off the timepiece.

Figure 3:
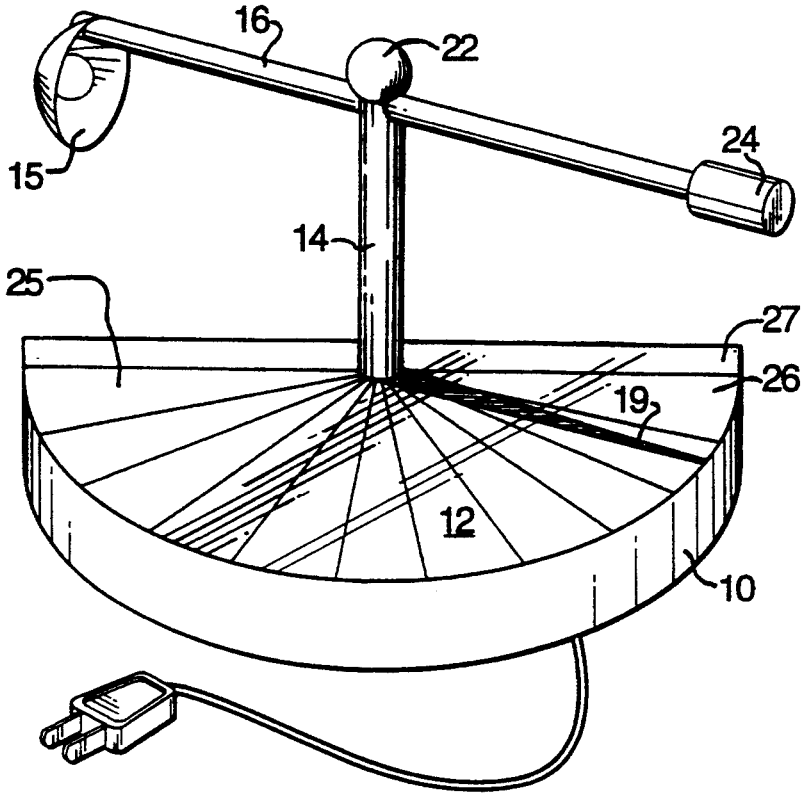
FIG. 3 is an alternative embodiment of a timepiece in accordance with the present invention showing the time interval markings being disposed over less than 360° of the timepiece surface.

The full 360° of the surface 12 may be divided into either twelve or twenty four time intervals, and twelve or twenty four time interval markings 13 inscribed at the relevant positions. However, any angle of the surface 12 less than 360° may be divided into either twelve or twenty four time intervals and the surface 12 marked accordingly. An example of this is shown in FIG. 3. The light source 15 does also not need to revolve through a full 360°. It can be moved from a first position 25, relative to a first time interval marking 26, to a second position 27 remote from the first position 25 and then swung back to the first position 25 by a spring mechanism, not shown. A suitable type of spring mechanism is well known in the art.

The light source 15 which may be used in this invention may be incandescent, neon, fluorescent, halogen, laser etc., with or without a magnifying lens (not shown). The motor and other parts of the clock mechanism can be mechanical, electric, quartz or any other suitable mechanism which can move the light source on a twelve or twenty four hour cycle.

Variations in the present invention will be obvious to those skilled in the art, and any such obvious variations are contemplated to fall within the scope and purview of the invention disclosed and claimed herein.

The embodiments of the Invention in which an exclusive property or privilege is claimed are defined as follows:

1. A timepiece comprising:

a conventional clock mechanism including a surface having a perimeter defining at least a pan circle with a plurality of time interval markings inscribed thereon about the said perimeter, and an electric motor mounted below said surface, a symmetrically-shaped gnomon having a longitudinal axis mounted on said surface substantially at 90° to said surface, a drive shaft operatively connected to the electric motor for rotation by the electric motor, said drive shaft having a distal end extending through the gnomon coaxial therewith, a support arm connected to the distal end of the drive shaft for rotation therewith in a planed parallel to the surface, said support arm having opposite ends substantially coextensive with the perimeter of the surface, and electrically energized illumination means supported at one end of the support arm for illuminating said gnomon to cause a symmetrical shadow of the gnomon to be cast upon the surface, whereby as the illumination means moves relative to the circular perimeter of the surface, the symmetrical shadow of the gnomon moves in succession across each of the time interval markings beneath the other end of the arm, thus permitting time to be read off the timepiece.

2. A timepiece as defined in claim 1, wherein the motor moves the illumination means relative to the surface on a twelve hour cycle.

3. A timepiece as defined in claim 1, wherein the motor moves the illumination means relative to the surface on a twenty-four hour cycle.

4. A timepiece as defined in claim 2, wherein the surface is inscribed with twelve equal time interval markings.

5. A timepiece as defined in claim 3, wherein the surface is inscribed with twenty-four equal time interval markings.

6. A timepiece defined in claim 1, wherein said gnomon is stationary and said illuminating means is caused to move relative to said surface and to said gnomon.

7. A timepiece as defined in claim 1, wherein said gnomon rotates in unison with said illuminating means.

8. A timepiece as defined in claim 1, wherein the illumination is disposed proximate one end of the arm and a counterbalance means is disposed proximate the opposite end of the arm.

* * * * *